United States Patent [19]

Bathurst

[11] 4,082,285

[45] Apr. 4, 1978

[54] ELECTRONIC CHESS GAME

[76] Inventor: David B. Bathurst, 19857 Susan Ct., Mount Clemens, Mich. 48043

[21] Appl. No.: 741,787

[22] Filed: Nov. 15, 1976

[51] Int. Cl.[2] ..... A63F 3/02

[52] U.S. Cl. ..... 273/237; 340/323 R

[58] Field of Search ..... 273/1 E, 85 R, 130 AB, 273/131 A, 136 A, DIG. 28; 340/323 R

[56] References Cited

U.S. PATENT DOCUMENTS

| | | | |
|---|---|---|---|
| 3,654,392 | 4/1972 | Beinhocker et al. | 273/136 A X |
| 3,843,132 | 10/1974 | Ferguson | 273/136 A |
| 3,888,491 | 6/1975 | Bernard et al. | 273/136 A |
| 4,019,745 | 4/1977 | Mustelier | 273/136 A |

FOREIGN PATENT DOCUMENTS

| | | | |
|---|---|---|---|
| 500,803 | 5/1976 | U.S.S.R. | 273/136 A |

OTHER PUBLICATIONS

*Popular Science;* "Games Computers Play"; vol. 197, No. 4, Oct. 1970; p. 44.

*Primary Examiner*—Richard C. Pinkham
*Assistant Examiner*—Vance Y. Hum
*Attorney, Agent, or Firm*—Basile and Weintraub

[57] ABSTRACT

An electronic chess game is provided, including a playing board surface made up of a number of push-button squares. Display circuitry is provided for displaying at each of the squares an image of any one of the playing chess pieces required for the chess game. Logic circuitry is provided to permit each of the chess players to selectively cause the chess images to be automatically transferred from one square to another. Recall circuitry is provided so that a player can recall a partially completed or a totally completed prior move. The logic circuitry also includes storage circuitry and auxiliary storage circuitry both in the form of flip-flops. Replacement circuitry is provided for replacing a pawn that has moved through the opponent's ranks into the opponent's back row. Indicator circuitry is provided to indicate when it is a particular player's turn. Also provided is a double transfer circuitry for allowing the particular players to "castle" and a means for an "En-Passant" (in passing) move. When one of the player's pieces is captured by the other player, that captured piece appears in the capturer's specially designated area.

3 Claims, 16 Drawing Figures

FREE CHOICE
CIRC
PRISONERS
NOW PLAYING
RE-CALL
ON
RESET
2
4
6
8
10
12
14
16
18
20
22
24

MASTER CLOCK 70
ALL SW2 ( )'S OR'D TOGETHER
DELAY
108

SW 3 (b)
SW 1 (B)
SW 6 (b)
SW 2 (B)
FROM MASTER STORAGE J OUTPUTS 76
SW 4 (b)
22 & 24
STORAGE CLOCK 40
102
106
6 & 8
18

SW 1 (B)
SW 5 (C)
ALL SW2 (b)'s OR'D TOGETHER
FROM MASTER STORAGE J OUTPUTS-76
SW 6 (B)
104
RESET MASTER 72

AUX. CLOCK 60
SW 2 (b)
SW 3 (b)
SW 4 (b)
INV.
INV.
INV.
TO QUEEN'S CASTLE AND KINGS STORAGE
TO KING'S CASTLE AND KINGS STORAGE

ELECTRONIC CHESS GAME

BACKGROUND OF THE INVENTION

I. Field of the Invention

This invention relates to a system and apparatus for displaying successive moves on a game board or on a display board and, more particularly, to displaying on a chessboard or on an enlarged display board not only the positions of the various chess pieces on the board for both the white and black pieces, but also to selectively displaying changes in the positions of said such pieces in response to moves made by either the white side or the black side. Furthermore, the subject apparatus provides for any moves or changes in positions of the pieces as they regularly occur during the course of a typical chess game.

II. Description of the Prior Art

There have been many attempts in the past to provide for the display on a chessboard the various chess pieces without providing for the particular chess pieces themselves. There has even been an attempt to show not only the position of the various chess pieces on the board, but also to selectively display changes in the position of such pieces in response to moves made either by the white side or the black side. Such a system is shown in the Harvey B. Bernard et al., U.S. Pat. No. 3,888,491, which issued on June 10, 1975.

Many systems cannot model or simulate many of the moves that regularly occur during the course of a chess game. Some of the moves include a castling move, or the ability to recall a partially completed move, or the ability to replace a pawn that has gotten through the opponent's ranks into his bank row with another piece, an en-passant move, or simply the ability to ascertain which pieces of the opponent have been captured. Because the prior art systems and apparatus have not been able to quickly and automatically account for such moves and piece positioning, it has been difficult to play such a game of electronic chess in a quick and easy fashion.

SUMMARY OF THE INVENTION

An electronic board game constructed in accordance with the instant invention comprises a playing board surface made up of a number of squares, a display means for displaying at each of the squares an image of any one of those playing pieces required for the game, and logic circuitry to permit each of the players of the game to selectively cause the images to be automatically transferred from one square to another. The logic circuitry includes recall means for selectively recalling the automatic transfer for placing the squares in the condition prior to the automatic transfer.

Other advantages of the present invention will be readily appreciated as the same becomes better understood by reference to the following detailed description when considered in connection with the accompanying drawings wherein.

DETAILED DESCRIPTION OF THE INVENTION

Figure 1:
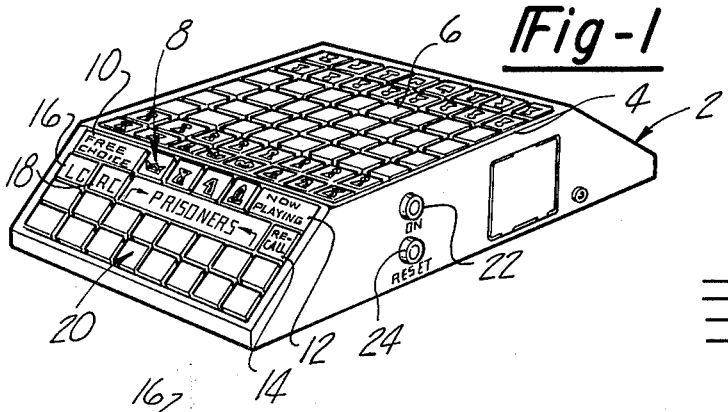
FIG. 1 is a schematic illustration of the electronic chessboard game.

In FIG. 1 is shown a chessboard console generally designated as 2. On the top plane of the console 2 is a playing surface 4 comprising a plurality of push-button squares 6. The squares 6 may be made of clear or frosted white and black squares, the white and black squares alternating as on a conventional chessboard. As on a regular chessboard, there are a total number of 64 playing squares.

Underlying each of the 64 playing squares 6, there is located a display unit which, after proper energization, is capable of producing a display image of any one of the six men used in the game of chess; namely, pawn, rook, knight, bishop, queen and king. One means of accomplishing this is to mount a multicathode tube, such as a well-known Nixie tube, beneath each square as is well known in the art. Another means for accomplishing this is to use light emitting diodes positioned beneath each of the squares. As is well known in the art, each Nixie tube and each light emitting diode type printed circuit may be shaped in the form of the six chess pieces.

Also shown in FIG. 1 are four free choice squares generally designated as 8. These free choice buttons or squares 8 are provided for each of the players. These squares 8 include a queen, rook, knight and bishop pieces. These squares 8 may be depressed in the same fashion as any of the squares on the playing surface 4. The timely depression of these squares 8 will be described in greater detail hereinafter.

Also included is a free choice button 10, a "now playing" light 12, a recall button 14, an LC or left castle button 16, and a RC or right castle button 18. These buttons and lights 10 through 18 will be described in greater detail hereinafter. It is sufficient to say here that these buttons and lights simulate, in an electronic fashion, the game of chess as it is actually played. Also shown in FIG. 1 are a plurality of squares generally designated as 20 which are not depressible but rather are used for display purposes only for displaying those pieces which have been captured by a player. In this way a player may quickly determine which of his opponent's pieces he has captured.

Also shown in FIG. 1 is an "on" button 22 which not only allows for the energization of the circuitry provided within the console 2 by a power supply (not shown), but also initializes each of the top playing squares 6 in its start or playing position. A reset button 24 is provided for allowing the reset of the top playing squares 6 at any time during the course of the game, for instance, after a particular preceding game has been won by one of the players. If the button 22 is depressed when the game is in progress, this second depression turns the game off by disconnecting the circuitry from the power supply, as is well known in the art.

Figure 2:
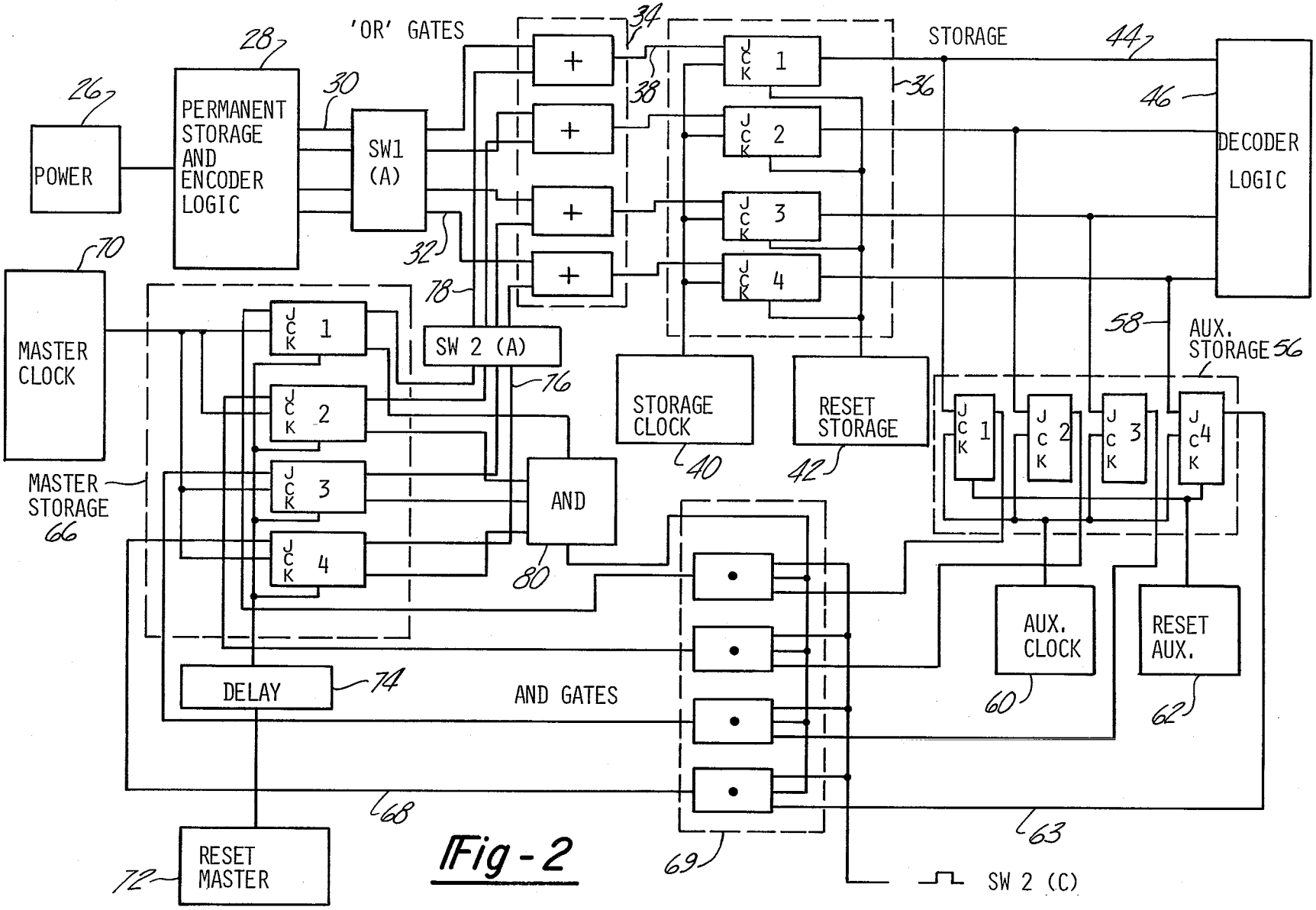
FIG. 2 is a combination block diagram and circuit diagram of the basic features of the present invention.

FIG. 2 shows a basic circuit diagram of the subject invention. Power supply 26 provides power to energize the associated circuitry of the subject invention. Permanent storage and encoder logic circuitry 28 stores permanently each of the pieces which are to be played, such as a knight, or bishop, or queen, etc. Rechargeable batteries may be employed to apply the necessary biasing potential when the game is not in use. Encoding of piece information may be accomplished in any of the ways known in the art, such as the way shown in U.S. Pat. No. 3,888,491. A four-bit binary system is shown in the above noted patent, which system may be used with the fourth bit designating the color or player designation.

Block SW1A designates a switch or a switch function of switch SW1 which represents either buttons 24 or 22 which are in parallel. Switch SW1A mechanically connects lines 30 leading from the permanent storage and encoder logic 28 to lines 32 which lead into a plurality of OR gates 34. Switch SW1A mechanically connects circuitry 28 to each of the back two rows of the black and white players, as shown in FIG. 1. The switch SW1A also mechanically interconnects the circuitry 28 to each of the desired squares 8 to thereby place the information from the circuitry 28 into the squares 8. The OR gates 34, as shown in FIG. 2, represent only the OR gates for a particular square 6. However, it is to be understood that each square 6 has OR gates such as the four OR gates 34 which provide an entry area for digital data before the data enters a storage 36 for each square 6. The storage 36, which again is only shown for one square, employs four JK flip-flops with reset capability. The flip-flops of the storage 36 are numbered 1 through 4, the first flip-flop indicating the first bit of encoded information, the second flip-flop indicating the second bit of encoded information, the third flip-flop indicating the third bit of encoded information, and the fourth flip-flop indicating the color or player designation of a particular piece. Data information existing on lines 38 is clocked into the J inputs of flip-flops of the storage 36 by means of a storage clock 40, which will be described in greater detail hereinafter. The flip-flops of the storage 36 are reset by a reset storage 42, which also will be described in greater detail hereinafter.

Figure 8:
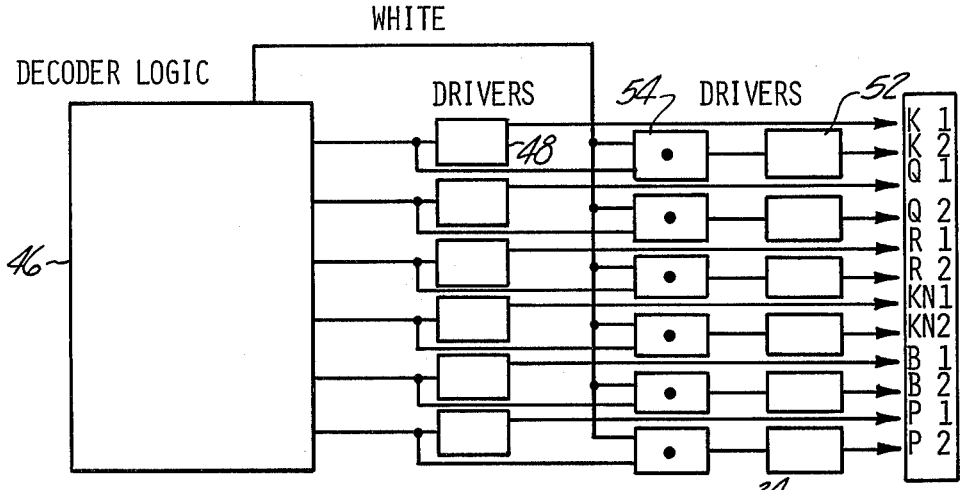
FIG. 8 shows the decoder logic of FIG. 2 and its associated drivers for use in displaying the playing pieces.

Data which is stored within the flip-flops of the storage 36 is fed along lines 44 leading from the ONE or high outputs of the flip-flops to decoder logic 46 such as the decoder logic shown in the above noted patent. The decoder logic 46, which is also shown in FIG. 8, decodes the information and passes the information through suitable drivers 48 to a display 50 in much the same fashion as shown in the above noted patent. The display 50 of the present invention, however, is different in that a second pair of drivers 52 are provided to drive the display unit 50 which has not only one set of Nixie tubes or light emitting diodes beneath each square, but also has a second pair of Nixie tubes or light emitting diodes beneath each square. The second set of light emitting diodes or Nixie tubes is activated by drivers 52 when the decoder logic 46 has sensed the fourth bit of information as indicating a white piece and Anding this information by means of AND gates 54 to provide a second set of signals to activate the second set of Nixie tubes or light emitting diodes as indicated by K2, Q2, R2, KN2, B2, and P2. In this way a white piece is indicated by a double image of the piece.

Also shown in FIG. 2 is an auxiliary storage 56, also for one square 6, comprising four JK flip-flops, also labeled 1, 2, 3 and 4, corresponding and connected to the ONE or high outputs of the JK flip-flops of the storage 36 along lines 58. The auxiliary storage 56 has an auxiliary clock 60 which clocks data information appearing on lines 44, and, therefore, lines 58, into the J inputs of the JK flip-flops of the auxiliary storage 56. A reset auxiliary 62 is provided to reset each of the JK flip-flops of the auxiliary storage 56. Both the auxiliary clock 60 and the reset auxiliary 62 will be discussed in greater length hereinafter with reference to the remaining figures.

The ONE or high outputs of each of the JK flip-flops of the auxiliary storage 56 are fed along lines 63 into a plurality of AND gates 64, which AND gates 69 gate the information from the JK flip-flops of the auxiliary storage 56 into the corresponding J inputs of the JK flip-flops of a master storage 66 along lines 68. A master clock 70 clocks the information on lines 68 into the JK flip-flops of the master storage 66. A reset master 72 resets each of the JK flip-flops of the master storage 66 after the reset signal emitted by the reset master 72 has been delayed by delay circuitry 74. Each of the master clock 70, the reset master 72, and the delay circuitry 74 will be described in greater detail hereinafter with reference to the following figures.

Each of the J outputs of the JK flip-flops of the master storage 66 are mechanically connected along lines 76 to lines 78 leading into the OR gates 34 by means of switch SW2A. Switch SW2A mechanically connects the J outputs of the JK flip-flops of the master storage 66 when a playing square 6 or squares 8 are depressed, thereby mechanically and electrically connecting the master storage 66 to the particular OR gates 34 of the particular square 6 depressed.

AND gate 80 logically Ands the ZERO or low outputs of the flip-flops of the master storage 66 and provides a signal to the AND gates 69 when the ZERO outputs are all in a high or logical ONE state.

The description of the operation of the subject invention will now proceed with the understanding that a box which has a + or "cross sign" enclosed therein designates a logical OR gate, and a box or rectangle which has enclosed therein a dot or period (.) is a logical AND gate.

Figure 11:
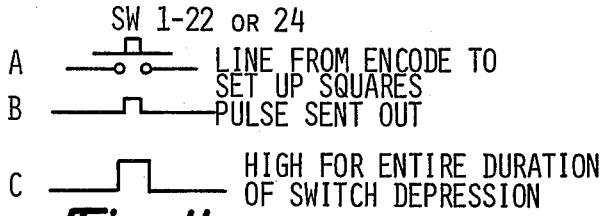
FIG. 11 is a detailed illustration of the various switch functions of the "reset" and "on" switches of FIG. 1.

Initially, the "on" button 22 is depressed to supply power to the console 2. As shown in FIG. 11, the button 22 is in parallel with reset button 24, both buttons 22 and 24 being represented by SW1. SW1A represents the physical or mechanical interconnection between the permanent storage and encoder logic 28 along lines 30 to all of the OR gates 34 of each of the squares 6 of the back two rows of the white and black players along lines 32. SW1A mechanically or physically interconnects lines 30 to lines 32.

Figure 4:
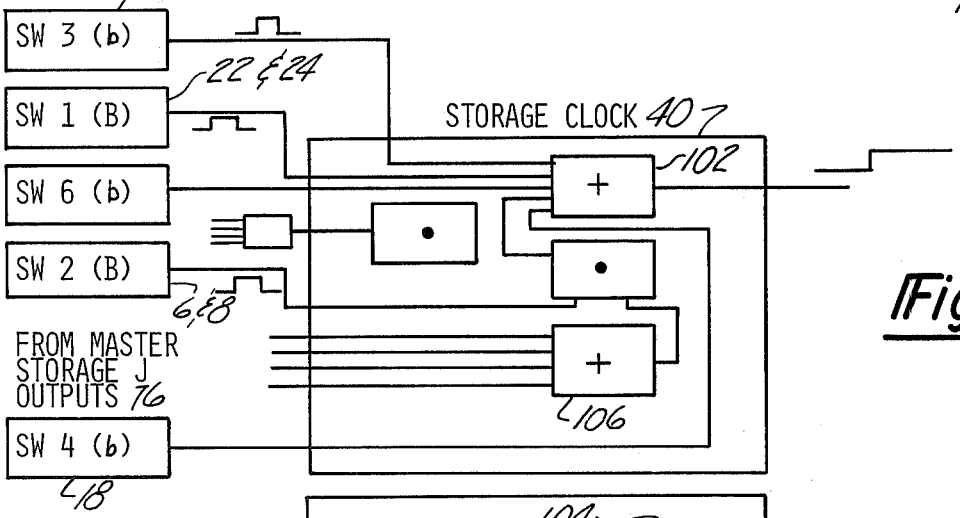
FIG. 4 is a detailed illustration of a storage clock of FIG. 2 and its associated inputs.
Figure 5:
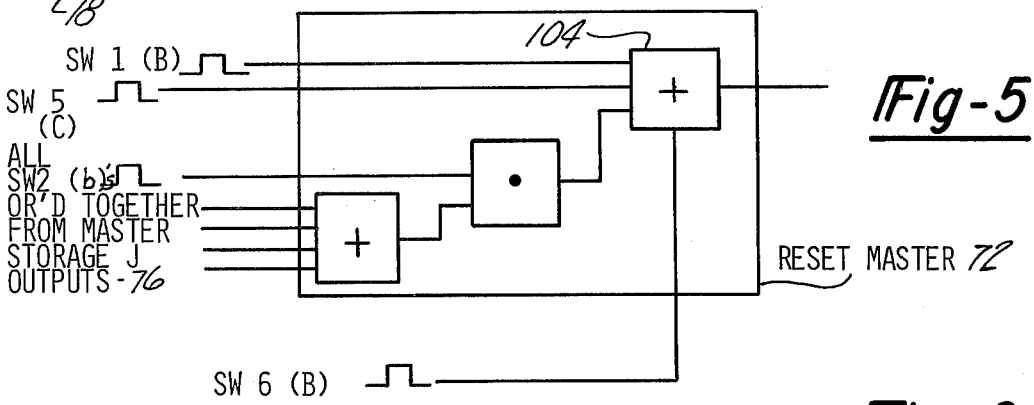
FIG. 5 is a detailed illustration of the reset master of FIG. 2 and its inputs.
Figure 10:
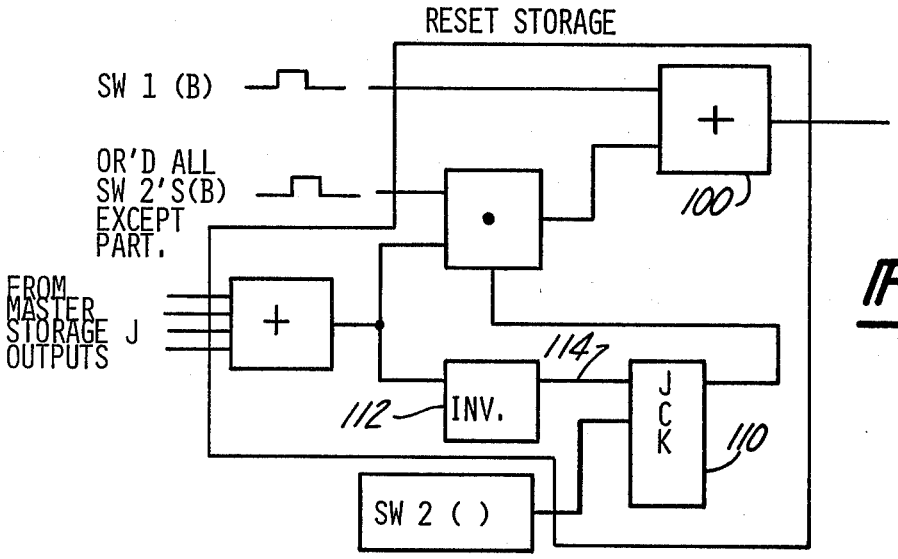
FIG. 10 is a detailed illustration of the reset storage of FIG. 2 and its associated inputs.

SW1B of SW1 also sends out a pulse of sufficient duration to reset all of the storages 36 of each of the squares 6, as shown in FIG. 10, through OR gate 100. The pulse SW1B is to be compared with the pulse SW1C, which pulse has a width equal to the time that the button 22 or the button 24 is depressed. In other words, SW1B is but a fraction of the width of SW1C. The letter A of SW1, as well as of other switches, indicates a physical or mechanical interconnection, while the letters B and C indicate pulses. Furthermore, SW1B is used to clock in the information existing on lines 38 into the storage 36 as the information comes through the mechanical connection of SW1A, as shown in FIG. 4. SW1B clocks the information through OR gate 102 of the storage clock 40. SW1B also resets the master storage 66 by way of reset master 72 through OR gate 104 after a slight delay introduced by the delay circuit 74, which may be any delay circuit employed to delay a pulse as is well known in the art.

After pressing buttons 22 or 24, all of the squares 6 and 8 are set up as shown in FIG. 1, all of the storages 36 and auxiliary storages 56 are reset, and the master storage 66 is reset. Now the console 2 is ready for playing.

Figure 6:
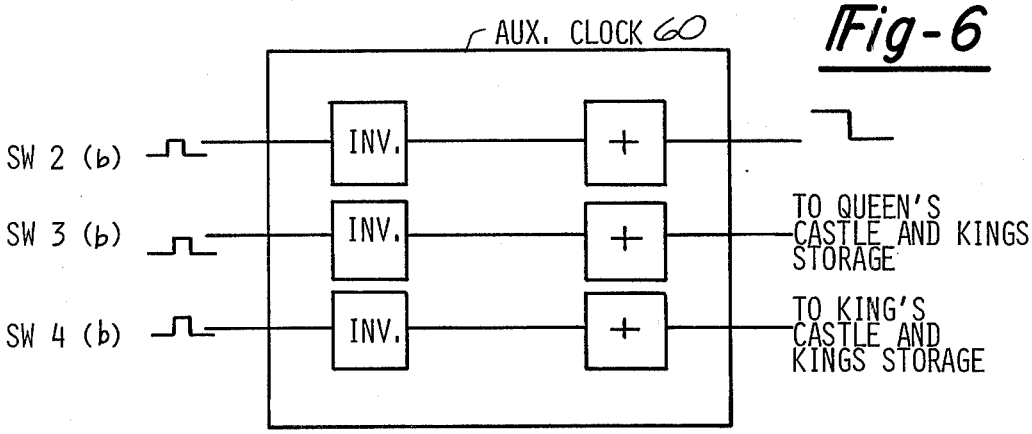
FIG. 6 is a detailed illustration of the auxiliary clock of FIG. 2 and its inputs.
Figure 12:
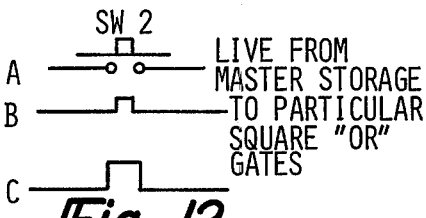
FIG. 12 is similar to FIG. 11 in that it shows associated functions which occur when either one of the 64 playing squares has been depressed or one of the "desired" squares has been depressed.

A move may be made by first depressing a particular square 6 which is the square to be moved. The J outputs of each of the flip-flops of the master storage 66 are in a low or ZERO condition, which condition is indicated on lines 78. The depression of the particular switch SW2 provides for the mechanical interconnection of lines 76 and 78, as previously indicated by SW2A. As shown in FIG. 12, SW2A ties the lines from the master storage to the particular square, OR gates being referenced by the switch SW2. However, no data information is clocked into the storage 36 by means of the storage clock 40 since there is no data along lines 76 to activate OR gate 106 whose output is Anded with SW2B of SW2. By depressing a particular SW2, the data in the storage 36 of that particular square 6 is clocked into its auxiliary storage 56 on the leading edge of SW2B by means of auxiliary clock 60. As shown in FIG. 6, SW2B is inverted to thereby clock the information data from the storage 36 into the auxiliary storage 56 on the leading edge of SW2B.

Figure 3:
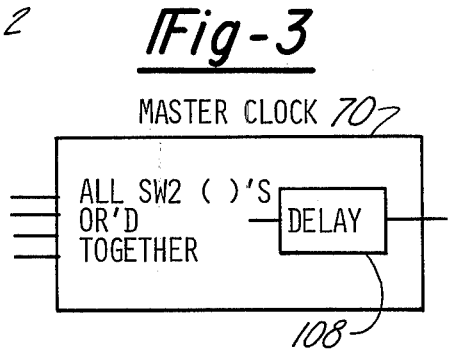
FIG. 3 is a detailed illustration of the master clock of FIG. 2.

After the data on lines 44 of the storage 36 has been clocked into the auxiliary storage 56 along lines 58, the data continues on through AND gates 64 as long as SW2 is depressed as indicated by SW2C, which is Anded together with the J outputs of the flip-flops of the auxiliary storage 56 along lines 63. Since there is no data in the master storage 66 at this point, AND gate 80 provides a high signal and therefore the data contained in auxiliary storage 56 appears on lines 68 to be clocked into the master storage 66 by master clock 70, which is shown in FIG. 3 to be all the SW2(*b*) pulse signals logically Or'd together and subsequently delayed.

After the data has been clocked into the master storage 66, AND gate 80 disables the AND gates 69 to prohibit any more data from flowing into the master storage area 66 from any other auxiliary storage source. As shown in FIG. 3, master clock 70 comprises all of the SW2B pulses caused to be emitted by the depression of squares 6 and 8, all together sent through delay circuitry 108 which subsequently clocks data into the master storage 66. The circuitry 108 is used so that the data, which is clocked into the master storage 66, is not subsequently clocked into storage 36 via a SW2(*b*) pulse since the storage clock 40 also uses the SW2B pulse as a clock pulse, as shown in FIG. 4.

The SW2B pulse also sets flip-flop 110 in a high condition on its trailing edge as shown in FIG. 10 wherein it can be seen that since there is no information on the master storage high outputs 66, the inverter 112 causes the J input line 114 to go high, which high state is clocked into the flip-flop 110 by way of switch SW2B.

Figure 7:
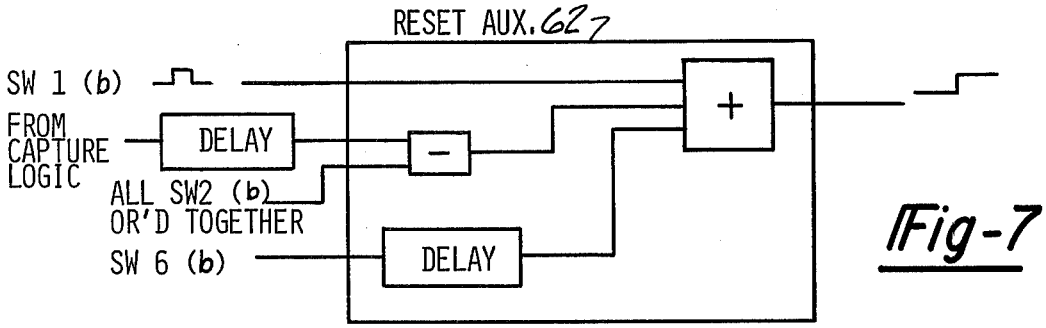
FIG. 7 is a detailed illustration of the reset auxiliary of FIG. 2 and its associated inputs.
Figure 13:
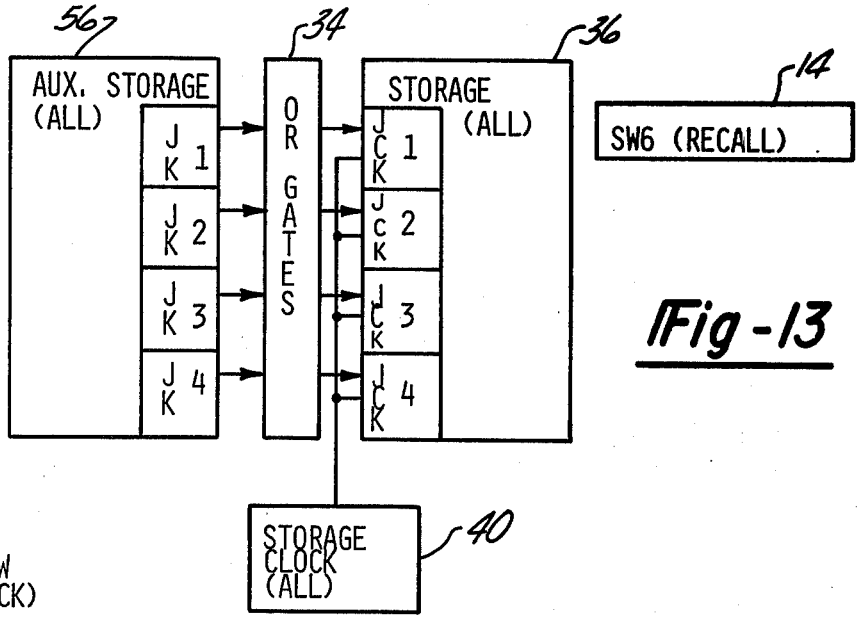
FIG. 13 is a partial block diagram of what occurs when the recall button is depressed.

If at this point the depression of the previous square 6 is recalled, SW6 or button 14 is pressed. The recall button 14 is depressed to thereby cancel that partial move. The player light 12 remains "on," and a flip-flop 116 of the particular player light circuitry (white shown in FIG. 16) is reset by pulse SW6(*b*) through an OR gate 118. At the same time, the data contained in all of the auxiliary storages 56 is placed back into their associated storages 36, as indicated in FIG. 13, through the OR gates 34 upon being clocked by the storage clocks 40. As shown in FIG. 4, clock pulses will only come from the storage clocks 40 when some information previously existed in the particular auxiliary storage 56. Thereafter, all of the auxiliary storages 56 are reset after a delay long enough to allow for the transfer from the auxiliary storages 56 to the storages 36, as shown in FIG. 7.

Figure 16:
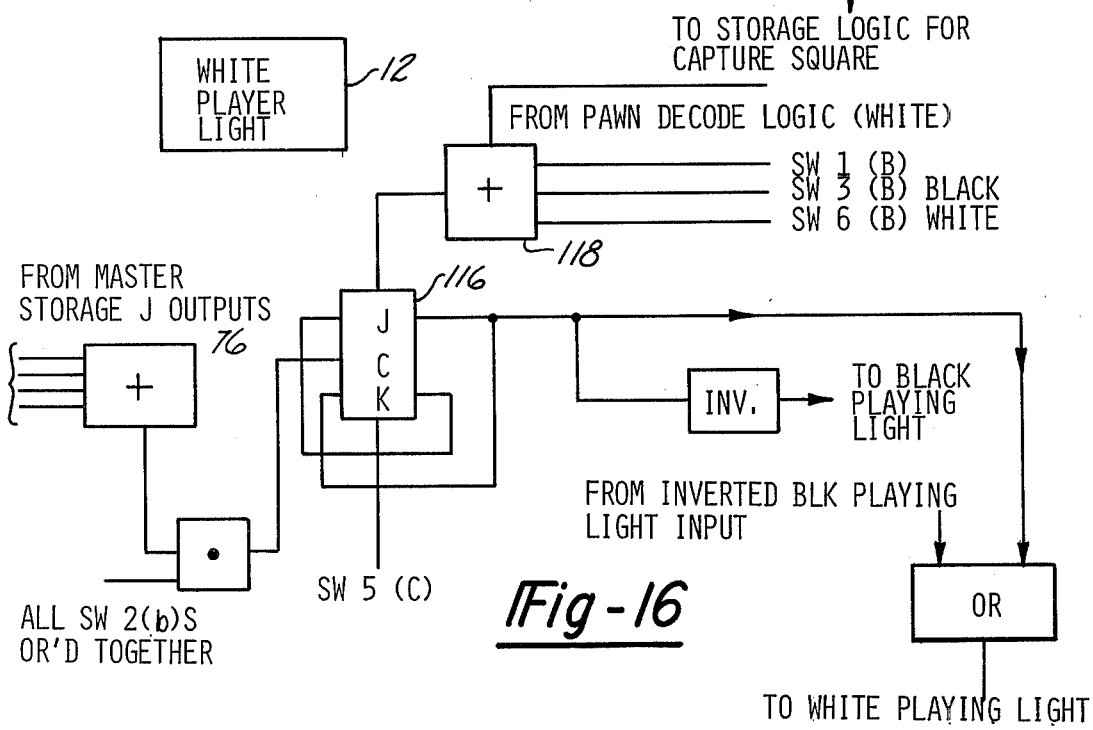
FIG. 16 shows logic circuitry and inputs to that circuitry for energizing the white player's light.

To complete the above noted move, a second square 6 is depressed, which second square is the desired location for the first depressed square's image. When this occurs, the player light 12 goes out, as shown in FIG. 16, since information existed in the master storage 66 upon the second depression to change the state of the flip-flop 116. Also, the initially depressed square's storage 34 is reset, as indicated in FIG. 10, since flip-flop 110 is in a high condition upon the occurrence of the pulse emitted by the logical Oring of all the SW2(*b*)'s except the particular SW2 (the first depressed SW2).

The storage clock 40 of the second depressed square 6 clocks the data from the master storage 66 into the particular storage 36, as shown in FIG. 4, since there is information along the J output lines 76 of master storage 36. Before the storage 36 changes its state, however, the prior information in the storage is clocked into the particular auxiliary storage 56 on the leading edge of the SW2(*b*) pulse, as shown in FIG. 6.

Also, it is noted that the delay 108 of the master clock 70 is shorter than the delay 74 between the reset master 72 and the master storage 66, so any data that may happen to enter the master storage 66 is expelled by the reset. At this time, the the master storage 66 is reset for the next turn.

If after depressing the second square 6 the recall button 14 is depressed, everything occurs as before.

Figure 14:
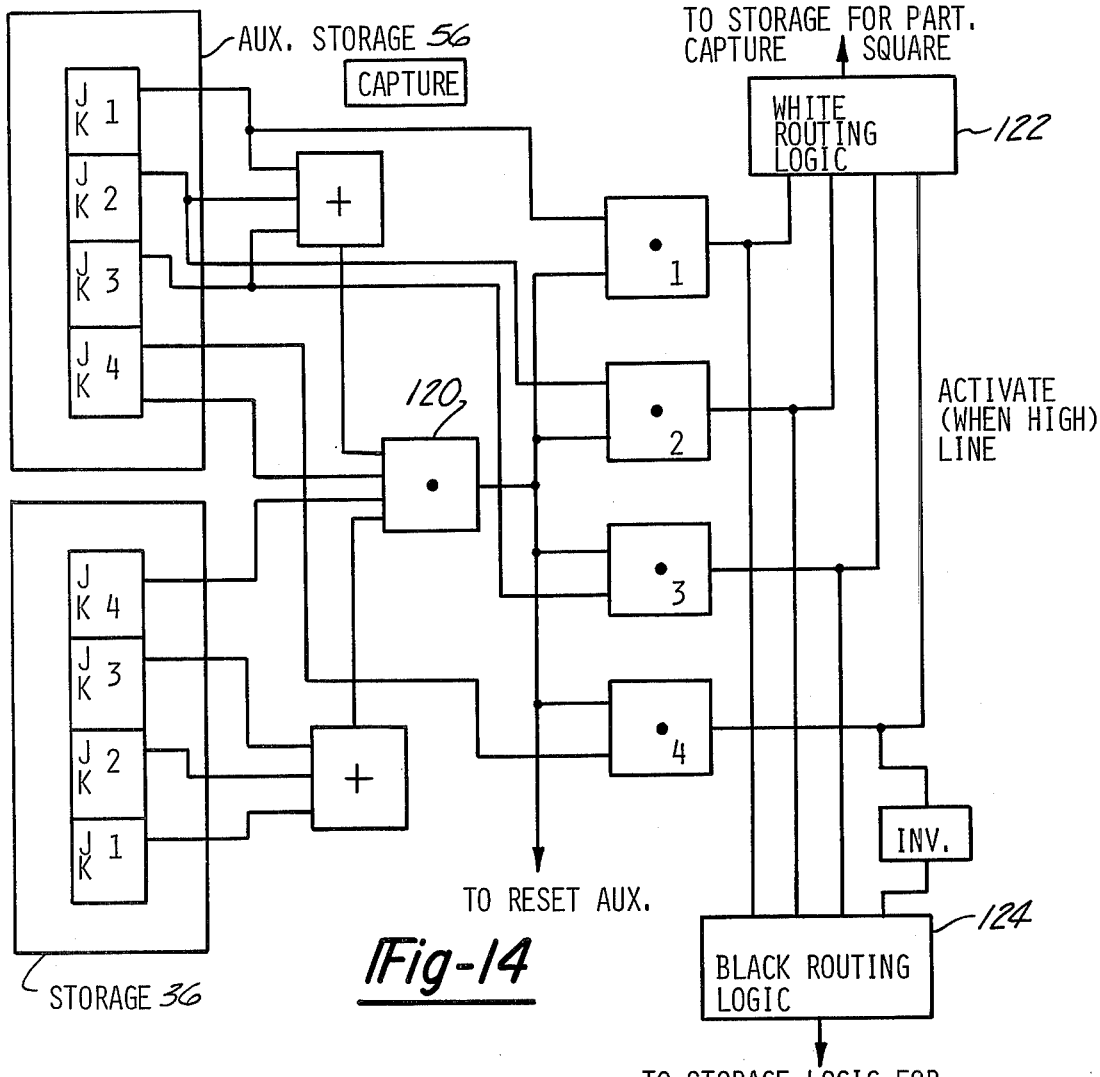
FIG. 14 is a partial block diagram and circuit diagram showing the logic used when one piece has captured another piece of a different color.

If a "capture" occurs on the second depression of a square 6, the capture circuitry shown in FIG. 14 comes into play or use. Basically, the capture circuitry detects if data existing in the storage 36 and the auxiliary storage 56 are of opposite color, as indicated by the fourth bit of information stored therein. If such a detection occurs by AND gate 120 going "high," the information in the auxiliary store (the captured piece) is routed via either the white routing logic 122 or the black routing logic 124 to the capture square displays of the capture squares 20. Such routing, which is well known in the art, places the captured piece at an unoccupied capture square 20 by clocking it in the capture square's storage. (Reset of the capture square storage is via SW1(*b*) or via SW*b*(*b*) via the routing logic.) In this way all pieces that have been captured can be displayed.

Figure 9:
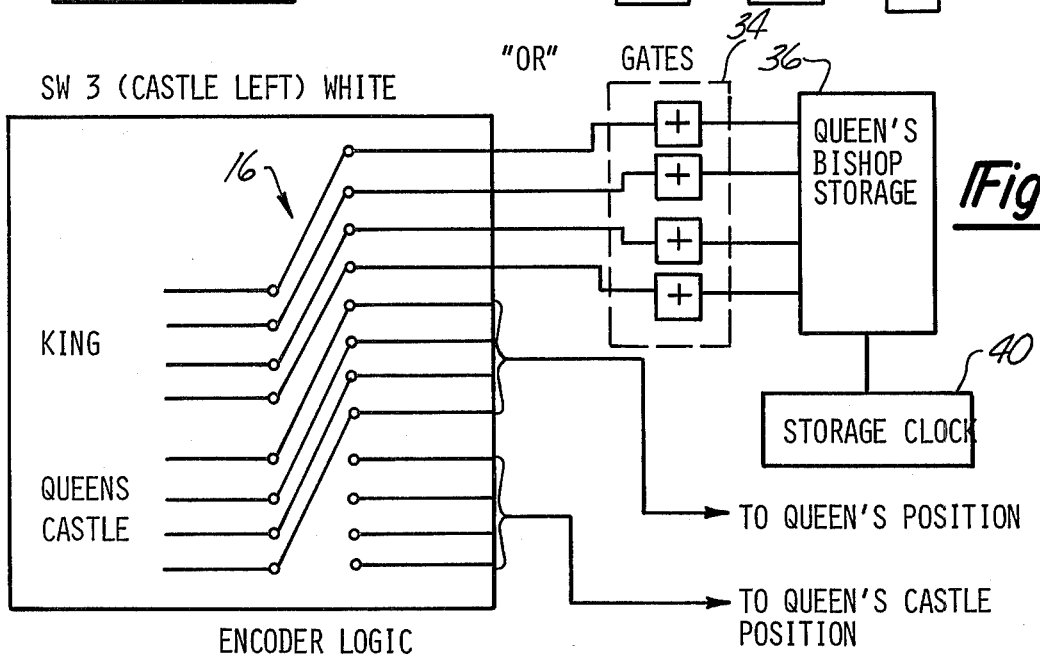
FIG. 9 is a detailed illustration of the castling mechanism or method of the present invention.

Castling of the white player to the left is shown in FIG. 9. Castling is accomplished by physically or mechanically reconnecting the queen's castle encoder logic to the queen's storage 36 and reconnecting the king's encoder logic to the queen's bishop's storage 36, all by means of SW3 or LC button 16. Storage clock 40, as shown in FIG. 4, emits a pulse via OR gate 102 to clock the data into the two particular storages 36 affected.

Figure 15:
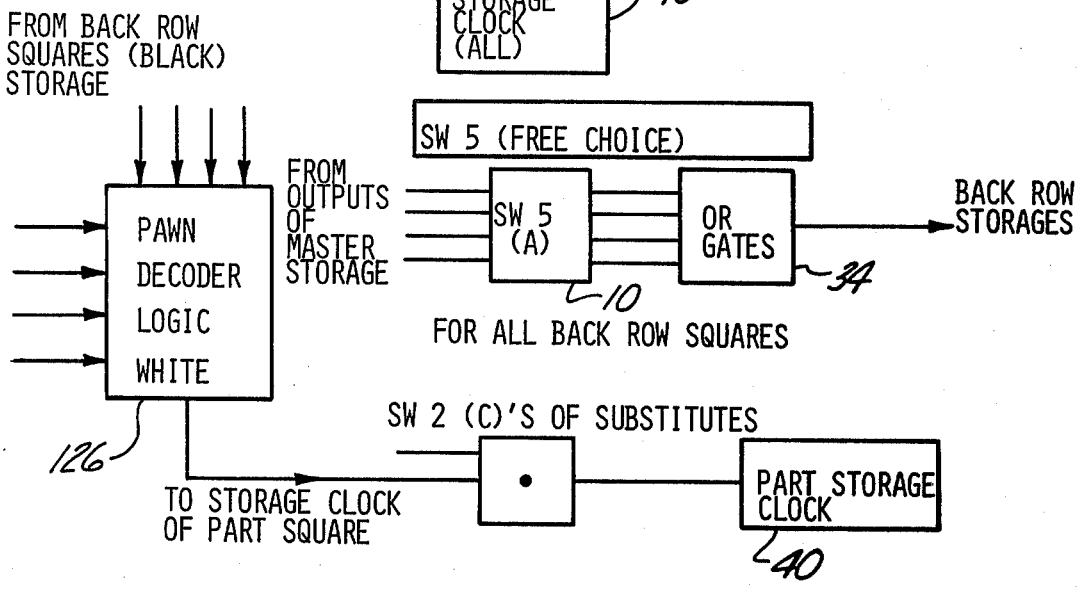
FIG. 15 is a partial block diagram and circuit diagram showing in a functional fashion what occurs when a pawn has reached the back row of his or her opponent and the free choice button is depressed.

If a player's pawn reaches his opponent's last row, that pawn may be replaced by a desired piece, as shown at 8 in FIG. 1. Initially, the desired piece 8 is depressed (another SW2), then the free choice button 10 (SW5) is depressed. The desired piece 8 is then released and the transfer is completed. FIG. 15 shows all the required circuitry to accomplish this function.

A pawn decoder logic unit 126 indicates the presence of a pawn in the back row. Initially, when a pawn appears in the back row, that player's player light 12 is energized via OR gate 118. Depressing the desired piece 8 places that information into the master storage 56 in the same fashion as depressing a playing square 6. The SW2(C) pulse of the depressed desired piece or substitute piece 8 acts on its trailing edge as a clock pulse for the particular storage 36 in which the pawn is located.

The depression of the free choice button 10 also resets the particular player's player light 12, as shown in FIG. 16.

During a selected move one of the players may have to move his piece twice in order to permit the positioning of the piece employed by the other players. An example of such a double move occurs in an "En-Passant" move. Pawns, while moving straight forward, may capture only diagonally. The pawns have one peculiar capturing privilege, known as capturing en passant. When one side, say black, has a pawn advanced to the fifth row and an adjacent white pawn, which has not made its initial move, is advanced two squares, the black pawn may capture it as if it had moved only one square and the black pawn moved diagonally into the one square. In the instant game, if black is in the fifth row and white advances two squares, black must advise white that black will capture by an "En Passant." White then presses the recall button 14 and the white pawn is returned to its initial position. Thereupon white advances its pawn only one square, and black can then capture the white pawn in the normal manner.

It should be noted that the black and white players are distinguishable from each other by having one set of pieces illustrated by double-lined figures and the other set of pieces illustrated by single-lined figures, such as shown in FIG. 1, wherein the white pieces are double lined and the black pieces are single lined.

The invention has been described in an illustrative manner, and it is to be understood that the terminology which has been used is intended to be in the nature of words of description rather than of limitation.

While only one example of the present invention has been disclosed, it should be apparent to those skilled in the art that other forms of the invention may be had, all coming within the spirit of the invention and scope of the appended claims.

The embodiments of the invention in which an exclusive property or privilege is claimed are defined as follows:

1. An electronic board game comprising:

a first playing board surface made up of a number of depressible playing squares;

a first display means for displaying at each of said squares an image of any one of those playing pieces required for the game; and logic circuitry to permit each player of the game to selectively cause said image to be automatically transferred from a first square to a second square upon sequentially pressing the first and second squares wherein said logic circuitry includes replacement means for replacing the predetermined first display image with the second image after the transfer of said first displayed image to one of a predetermined number of playing squares defining a back row of the playing surface, said replacement means including image decoder means for sensing when said first display image is transferred to one of said predetermined number of squares and wherein said logic circuitry includes indicator means responsive to said image decoder means for indicating when a player is allowed to transfer images from one square to another and when the player is allowed to replace the first predetermined display image with the second image.

2. The game as described in claim 1 wherein said logic circuitry includes double transfer means for transferring a pair of images substantially simultaneously to a pair of squares thereby indicating a double transfer condition.

3. The game as described in claim 1 further comprising:

a second playing board surface operatively associated with said first playing board surface, and a second display means for displaying at said second playing board surface an electronic image transferred thereto and wherein said logic circuitry includes capture logic circuitry for transferring the electronic image of a captured playing piece from a captured square to said second display means for display thereof.

* * * * *